United States Patent [19]

Mallas

[11] Patent Number: 4,850,315

[45] Date of Patent: Jul. 25, 1989

[54] PUSH ROD

[75] Inventor: Angelos Mallas, Mt. Clemens, Mich.

[73] Assignee: The Budd Company, Troy, Mich.

[21] Appl. No.: 199,693

[22] Filed: May 27, 1988

[51] Int. Cl.[4] ..... F01L 1/14

[52] U.S. Cl. ..... 123/90.61

[58] Field of Search ..... 123/90.56, 90.6, 90.61; 72/360, 367

[56] References Cited

U.S. PATENT DOCUMENTS

| | | | |
|---|---|---|---|
| 1,594,471 | 8/1926 | Short . | |
| 1,663,191 | 3/1928 | Carlson . | |
| 1,823,419 | 9/1931 | Almen . | |
| 1,948,415 | 2/1934 | Cooper . | |
| 2,019,444 | 10/1935 | Church . | |
| 2,434,080 | 1/1948 | Rosa . | |
| 2,743,712 | 5/1956 | Hulsing | 123/90.61 |
| 2,818,843 | 1/1958 | Frank . | |
| 2,851,980 | 9/1958 | Kraicinski | 72/360 |
| 2,857,895 | 10/1958 | Scheibe . | |
| 2,897,805 | 8/1959 | Etzler . | |
| 2,960,080 | 11/1960 | Burnard et al. . | |
| 3,034,488 | 5/1962 | Reiners . | |
| 3,086,507 | 4/1963 | Mooney | 123/90.61 |
| 3,468,007 | 9/1969 | Nakamura . | |
| 3,549,853 | 12/1970 | Guido . | |
| 3,789,650 | 2/1974 | Alexoff | 72/360 |
| 4,218,996 | 8/1980 | Usui . | |
| 4,317,267 | 3/1982 | Usui . | |
| 4,436,063 | 3/1984 | Usui . | |
| 4,453,505 | 6/1984 | Holtzberg et al. | 123/90.61 |

FOREIGN PATENT DOCUMENTS

| | | | |
|---|---|---|---|
| 0479834 | 1/1952 | Canada | 72/360 |
| 0640247 | 4/1962 | Canada | 72/360 |
| 55-1446 | 1/1980 | Japan . | |
| 55-46025 | 3/1980 | Japan . | |
| 55-146211 | 11/1980 | Japan . | |
| 0155516 | 9/1984 | Japan | 123/90.61 |
| 59-225844 | 12/1984 | Japan . | |

*Primary Examiner*—Charles J. Myhre
*Assistant Examiner*—Weilun Lo
*Attorney, Agent, or Firm*—Harness, Dickey & Pierce

[57] ABSTRACT

A one-piece push rod and method of making same is provided which includes the step of swaging ends of a hollow tube so that end portions have been reduced to 90%–50% of the starting stock. Preferably, the tube is characterized by a thicker middle portion which tapers down to the ends of reduced diameter. Spherical seats of constant wall thickness are formed by first machining a taper on the tips and then cold forming the tapered tips with a punch.

19 Claims, 3 Drawing Sheets.

PUSH ROD

BACKGROUND

This invention relates to push rods for engines and is especially applicable for use in high speed, high compression ratio internal combustion engines for automotive and other uses.

DISCUSSION

Push rods are conventionally used between a rocker arm and cam follower in an internal combustion engine to control the opening and closing of valve seats in the engine cylinders. The following patent documents disclose a wide variety of push rod constructions: U.S. Patent Nos. 1,594,471; 1,663,191; 1,823,419; 1,948,415; 2,019,444; 2,434,080; 2,818,843; 2,857,895; 2,897,805; 2,960,080; 3,034,488; 3,468,007; 3,549,853; 4,218,996; 4,317,267; 4,436,063; Japanese Pat. Nos. 55-1446; 55-46025; 55-146,211; and 59-225844.

Hollow tubular push rods are desirable because they are generally stronger and stiffer than a solid rod of the same weight. One piece hollow push rods having spherical seats have been sold by the inventor of the present invention. These push rods consisted of elongated straight walled tubes having spherical ends that were cold formed using a combination of special forming tool and punch similar to the ones disclosed in FIGS. 3 and 5 herein. While those push rods were satisfactory, the present invention provides improvements thereto that are expected to provide increased performance characteristics. These characteristics are achievable without requiring the use of a multiple piece construction such as the use of inserts or the like at the ends of the push rods as disclosed in some of the above-mentioned patent literature.

SUMMARY OF THE INVENTION

According to the teachings of the present invention a single piece push rod is provided in the form of an elongated hollow tube having a middle portion with a larger outer diameter than the tube has near its ends. In a particular embodiment, the middle and end portions of the tube are cylindrical while the surfaces bridging the middle and end portions are tapered.

According to the method of this invention the original stock has a larger outer dimension than the finished push rod. The beginning stock is compressed, preferably by a swaging operation, to form first and second end portions of reduced diameter. Preferably, tapered surface portions that taper down from a thicker middle portion towards opposite ends of the tube are also provided. The tips of the tube are machined with a form tool to form a generally conical taper thereon. Then, the tapered tips are cold formed to generate a substantially spherical seat thereon.

BRIEF DESCRIPTION OF THE DRAWINGS

The various advantages of the present invention will become apparent to one skilled in the art upon reading the following specification in which.

DESCRIPTION OF THE PREFERRED EMBODIMENT

It should be understood from the outset that while this invention will be described in connection with one specific example, this example is just the best mode of currently practicing this invention and that other modifications can be made to this specific example without departing from the spirit and scope of the invention.

Figure 2:
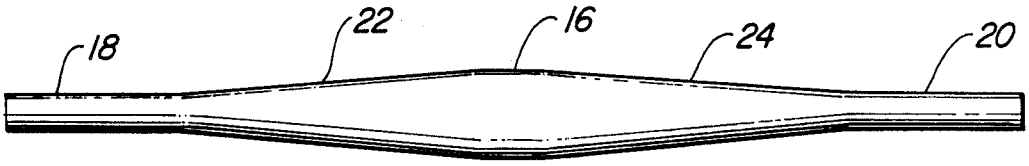
FIG. 2 is a plan view showing the tube after the completion of the swaging operation.

Turning now to Figure the starting stock is in the form of an elongated straight-walled, cylindrical tube 10. This specific example is directed to making a push rod with an outer diameter at its ends of 5/16 inch (0.3125 inch). The outer diameter of the starting stock is considerably larger, preferably about 0.375 inch and has a wall thickness of about 0.065 inch, although different wall thickness can be used. While other materials can be used, a chrome molybdenum alloy known in the trade as No. 4130 is presently preferred. Its length is about 8 inches. One end of the starting tube 10 is inserted into the rotating dies 12, 14 of a swaging machine. The swaging machine, per se, is of conventional design. As is known in the art, the dies 12, 14 rotate and draw the stock inwardly while they compress the metal into the shape of the dies. In the preferred embodiment, the dies are in the desired shape of ½ of the length of the push rod. The desired shape of the push rod after the swaging operation is shown in FIG. 2. It is characterized by a relatively thick flat cylindrical middle surface 16 which, in this example, has an OD of about 0.350 inch. The outer walls of the rod then taper downwardly to end portions 18 and 20 in the form of right circular cylinders (i.e., having flat, parallel walls when viewed in cross section), each having an outer diameter of about 0.311 inch (+0.005 inch, −0.000 inch). Thus, the end surfaces 18 and 20 will fit within conventional guide plates having a 5/16 inch slot. The length of surfaces 18 and 20 depends upon the location of the guide plates and should for practical purposes be between ¾ and 1½ inch. In this example, the axial length of surfaces 18 and 20 are each about 1.4 inch (±0.05 inch, −0.000 inch). Bridging middle surface 16 and end surfaces 18, 20 are conical tapered surfaces 22 and 24. Preferably, surfaces 22, 24 are linear although slightly convex surfaces should be acceptable. Concave surfaces and sharp corners are, generally to be avoided. In this example, the axial lengths of the tapered surfaces 22, 24 are each about 2.4 inch (+0.050 inch).

It is preferred that the end portions 18 and 20 are compressed so that their outer diameters are between 50–90% of the outer diameter of the original tube stock 10. In the above example, the end surfaces 18 and 20 have been compressed to about 83.2% of the original OD of the stock 10. Failure to reduce the end surfaces to at least 90% is disadvantageous because it probably would not result in the desired strength. On the other hand, if the surfaces 18, 20 were compressed to below about 50% of the original OD of the stock 10 then the inner bore would probably become closed and thereby restrict oil flow through the tube.

The middle portion 16 should be reduced, when necessary, to an outer diameter that is sufficiently small that it can fit within the engine block without interference and to generally avoid sharp corners. It may not be absolutely necessary to reduce the middle portion depending on the availability of starting stock with the appropriate size.

The swaging machine dies 12 and 14 are suitably shaped to meet these design constraints. Their interior surfaces define a cavity having a small right cylindrical portion 11 at the far end, a larger right cylindrical portion 13 at the front or feed end, with tapered conical surfaces 15 diverging from small end 11 to large end 13. The stock is fed into the machine until the stock reaches the point approximately shown in FIG. 1. Then the stock is removed from the machine, rotated and then reinserted into the machine so that the dies can swage the opposite half of the rod. As noted before, FIG. 2 illustrates the rod after the swaging or die drawing operation.

Figure 3:
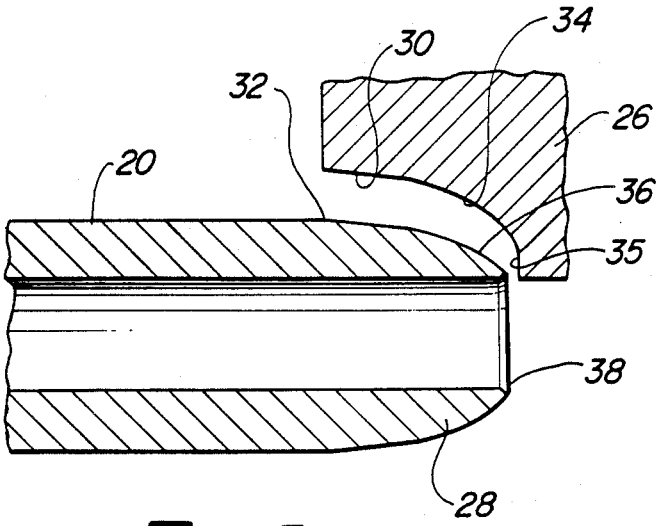
FIG. 3 is a partial cross-sectional view illustrating a tip of the tube after it has been machined with the form tool which is also shown therein.

Turning now to FIG. 3, the tips of end surfaces 18 and 20 are both machined with a forming tool 26 to form a generally conical taper 28 thereon which is about 0.210 inch in length. This is preferably accomplished by placing the tube in a lathe and rotating the workpiece while a forming tool 26 removes metal in the shape of its cutting surfaces. In this embodiment, the cutting surface of the forming tool 26 begins with a line segment or flat 30 which extends at about an 8° angle to the major axis of the tube. The flat in the tool 26 forms a corresponding flat conical surface 32 in the taper 28. The flat 30 blends into a arc 34 in the tool 26. The arc 34 has a radius of approximately 0.450 inch (±0.015 inch) whose center is offset from end face 35 by about 0.200 inch. The arc 34 in the forming tool thus forms a spherical surface 36 on the tips. A small chamfer 38 on the tips can optionally be formed to remove burrs and the like which may be created during machining with the forming tool 26. It should be understood that both ends or tips are likewise formed into the general shape shown in FIG. 3.

Figure 4:
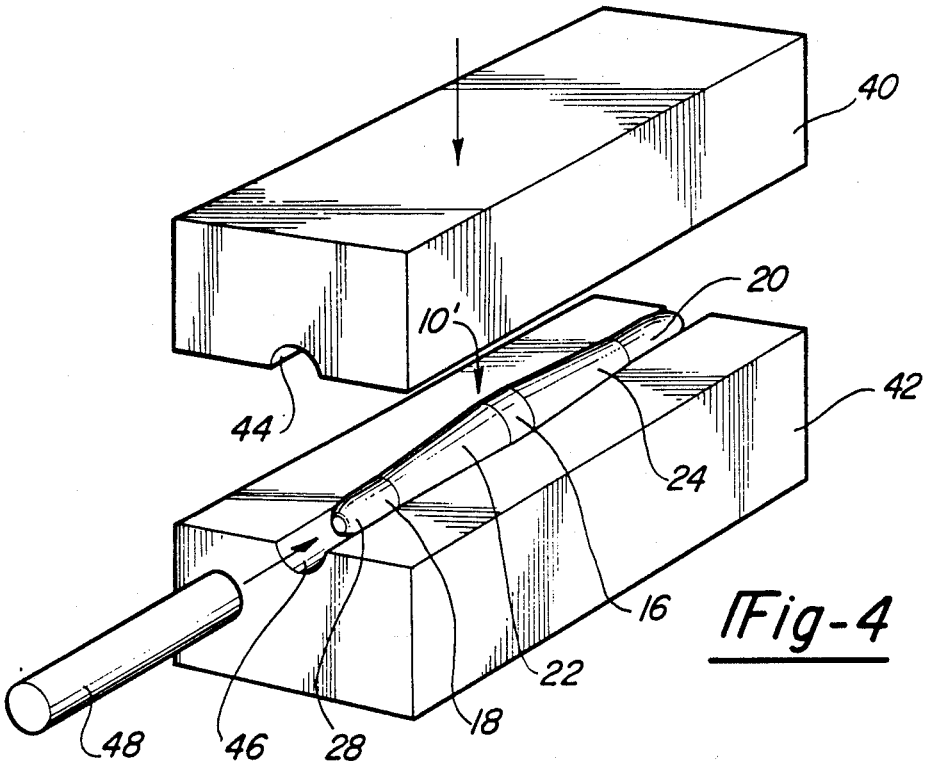
FIG. 4 is a perspective view showing the tube in a subsequent stage of operation.
Figure 5:
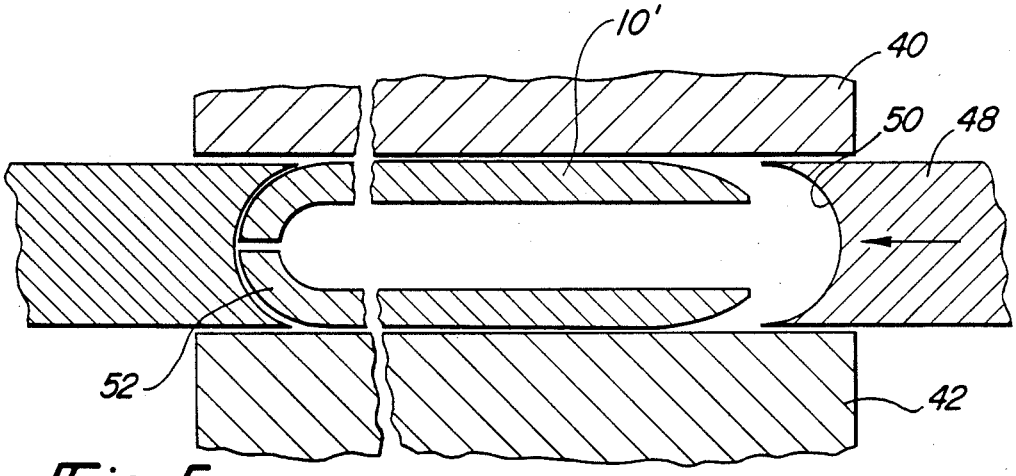
FIG. 5 is a "before" and "after" partial cross-sectional view which illustrates the formation of the spherical seat on the tips of the tube by a cold forming operation utilizing a punch which contacts the ends of the rods.

Turning now to FIGS. 4 and 5, the next step in the method is to place the semiformed rod 10' into a pair of holding dies 40 and 42. The dies 40, 42 have mutually opposing cavities 44, 46, respectively which correspond in shape to the outline of rod 10' and have bore extensions at both ends dimensioned to receive a punch 48 for cold forming the tips of the rod 10'. The holding dies 40, 42 are held together under pressure to prevent movement of the rod 10' during the cold forming operation which is shown best in FIG. 5. The right hand portion of FIG. 5 illustrates the relative shape of the rod tips before they are struck with the punch 48 whereas the left hand portion of FIG. 5 shows the shape of the tips after being cold formed. The punch includes a concave spherical striking surface 50 having about the desired diameter of the tips of the push rod. In this example, surface 50 has a radius of about 0.151 (±0.003 inch, 0.000) which approximates the desired 5/16 diameter spherical seat for the desired end product. The opposite end of the punch 48 is struck with sufficient force to cause the metal in the rod tip to flow together and form a spherical seat 52 which has substantially the same wall thickness as the wall thickness of the remaining portion of the rod.

Figure 6:
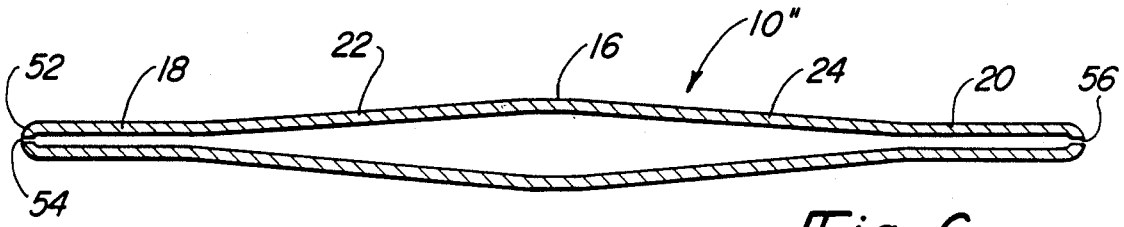
FIG. 6 is a cross-sectional view of a push rod made in accordance with the teachings of the present invention.

The final product 10'' is shown in FIG. 6, holes 54, 56 having been drilled into the seat 52. The purpose of the holes 54, 56 is to insure that oil flow is not impeded and to remove burrs, fragmented metal and the like.

Figure 7:
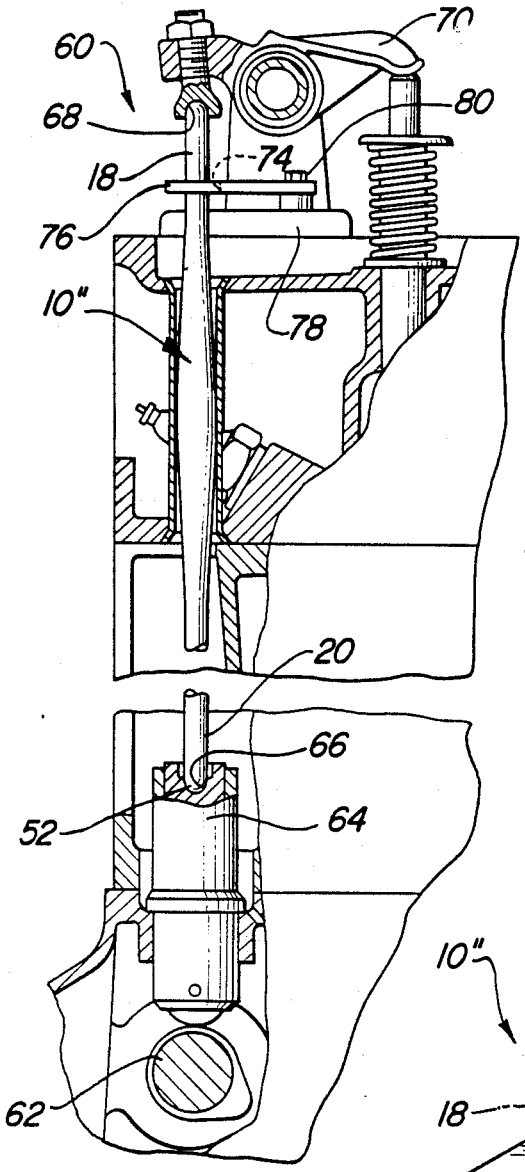
FIG. 7 is a simplified view showing the rod in use in an internal combustion engine.
Figure 8:
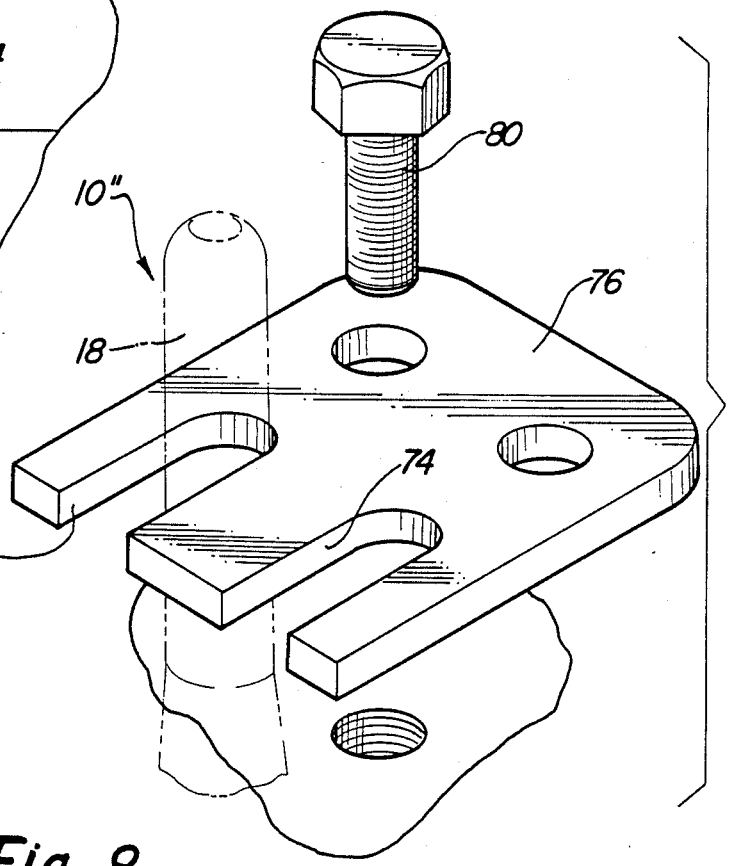
FIG. 8 is a perspective view of the rod and a typical guide plate.

FIGS. 7 and 8 illustrate the push rod 10'' in use in an internal combustion engine 60. The engine 60 includes a plurality of cylinders having intake and exhaust valves mounted on the head. The valves are opened by means of a cam 62 that pushes upward on cam follower 64. The seat 52 on the end portion 20 of push rod 10'' fits within a pocket 66 in the cam follower 64. The seat on the opposite end portion 18 engages the socket 68 formed in a rocker 70. The rocker 70 is suitably connected to the intake or exhaust valve. Cylindrical end portion 18 rides within one of the slots 72, 74 formed in a guide plate 76 which is suitably attached to the block 78 via fasteners 80. Guide plates such as plate 76 serve to prevent lateral movement of push rods and are often found in many high performance engines. They can be located at various locations within the engine. Thus, the length of the cylindrical end portion 18 of rod 10'' should be sufficient to accommodate for these different locations and for the reciprocal movement of the rod. In operation, the upward forces applied by cam 62 are translated through the push rod 10'' upwardly to rocker 70 causing it to open or close its associated valve. The hollow interior of push rod 10'' is used as a passageway for lubricating the various parts.

The push rod 10'' is relatively light weight, as compared with solid rods and thereby increases the efficiency of the engine. It is also expected to achieve better bending resistance and strength than conventional hollow push rods. Although it is not completely understood why the increased strength should result, it is believed that it is due to its tapered shape and the higher density of metal provided to the walls of the rod especially at its ends. The ends of a push rod are particularly susceptible to failure since they receive the primary force which can be quite large, especially in high performance engines. The tapered surfaces and/or the increased surface area per unit length of the rod tend to counteract forces which cause bending in the rod. Such bending is to be avoided since it can effect the performance of the engine. The design of the present invention does not require any modification of the other engine components and, in fact, can be interchangeable with conventional rods. All of these advantages are obtained without requiring the use of inserts or other nonhomogenous parts that have been welded or otherwise secured to the prior art push rods. Such inserts are known to fall off and can cause severe damage to the engine.

Various other advantages and modifications will become apparent to one skilled in the art after having the benefit of studying the teachings of this specification, drawings and following claims.

What is claimed is:

1. A push rod for an internal combustion engine comprising:

a single piece of metal in the form of an elongated hollow tube having a middle portion, first and second end portions and rounded seats at the tips thereof, said middle portion having a larger outer diameter than the end portions, and said tube having a substantially constant wall thickness throughout the length of the tube and the tips thereon.

2. The push rod of claim 1 wherein outer surfaces of the tube between the middle and end portions thereof symmetrically linearly taper from the middle portion towards the end portions.

3. The push rod of claim 1 wherein said middle portion and first and second end portion end portions have substantially flat cylindrical surfaces, and wherein the surfaces of the middle and end portions are parallel.

4. The push rod of claim 1 wherein the tips of the push rod define spherical seats.

5. The push rod of claim 1 further comprising, in combination, an internal combustion engine having a cam follower, a rocker and a guide plate with a slot therein, and wherein one of said cylindrical end portions of the push rod slides in the slot.

6. The push rod of claim 1 wherein the density of the metal in the end portions is higher than in the middle portion.

7. A one piece push rod made by the method of:

(a) providing a hollow metal tube having a given outer diameter;

(b) compressing the tube to provide substantially symmetrical conical surfaces that taper downwardly from a middle of the rod to opposite end portions thereof, the end portions being a right circular cylinder in shape and extending for a length of about ¾ to 1½ inch from the tips of the tube, the tube having a substantially constant wall thickness throughout the length of the tube and the tips thereon;

(c) machining tapers on the tips of the rod; and (d) cold forming each of the tapered tips to cause the metal to flow into a spherical seat having a substantially constant wall thickness as the walls along the length of the push rod.

8. In an internal combustion engine having a push rod between a rocker assembly and a cam follower assembly in which the push rod slides in a slot in a guide plate, the improvement wherein:

said push rod being a one piece hollow, metal tube swaged to a compressed shape characterized by end portions of reduced outer diameter relative to the middle of the tube and smoothly tapered surfaces therebetween, tips of the rod being formed into generally spherical seats, at least one of the seats being in direct engagement with the rocker assembly or cam follower assembly, said tube having a substantially constant wall thickness throughout the length of the tube and the tips thereon.

9. The improvement of claim 8 wherein the middle and end portions of the rod have parallel flat cylindrical surfaces.

10. The improvement of claim 8 wherein the tapered surfaces are substantially linear.

11. The improvement of claim 9 wherein one end portion of the tube slides in the slot in the guide plate.

12. The improvement of claim 11 wherein the outer diameter of the middle portion is about 0.350 inch and the tapered surfaces linearly converge down to outer diameters of about 0.312 inch for the end portions, with the overall length of the tube being about 8 inches and the length of the end portions each being ¾ to 1½ inch.

13. A method of making a one-piece push rod, said method comprising:

(a) providing a hollow tube having a given outer diameter;

(b) compressing at least the end portions of the tube to a reduced diameter relative to the outer diameter of the tube provided in step (a) said tube having a substantially constant wall thickness throughout the length of the tube and the tips thereon; and (c) forming tips of the tube into a desired shape.

14. The method of claim 13 wherein step (b) further comprises:

forming tapered surfaces from a middle portion of the tube down to the end portions thereof.

15. The method of claim 14 wherein step (b) is carried out in a swaging machine.

16. The method of claim 13 wherein step (b) comprises:

inserting a first half of the length of the tube into a swaging machine having rotating dies defining a cavity with a far end portion in the form of a right cylinder of reduced cross section, an opposite feed end portion defining a right cylinder of larger cross section, and tapered surfaces converging from the feed end portion towards the far end portion of reduced cross section;

using the dies in the swaging machine to reduce the outer diameter of the tube throughout its length while maintaining substantially constant wall thickness;

removing the tube and inserting the other half of the tube into the swaging machine; and using the swaging machine to form a substantially symmetrical shape on the other tube half as the first half.

17. The method of claim 14 wherein the swaging machine reduces the outer diameter of the end portions of the rod to between 90 and 50 percent of the outer diameter of the original tube.

18. The method of claim 13 wherein step (c) comprises:

machining the tips of the rod with a form tool to generate a substantially conical taper thereon; and cold forming the tapered tips of the rod to generate a substantially spherical seat thereon 19. The method of claim 18 wherein cold forming is carried out by hitting the tapered tips with a punch having a concave spherical striking surface.

* * * * *

UNITED STATES PATENT AND TRADEMARK OFFICE

CERTIFICATE OF CORRECTION

PATENT NO. : 4,850,315

DATED : July 25, 1989

INVENTOR(S) : Angelos Mallas

It is certified that error appears in the above-identified patent and that said Letters Patent is hereby corrected as shown below: On the title page:

Assignment to "The Budd Company" should be deleted and insert therefor --Mall Tooling and Engineering--.

Figure 1:
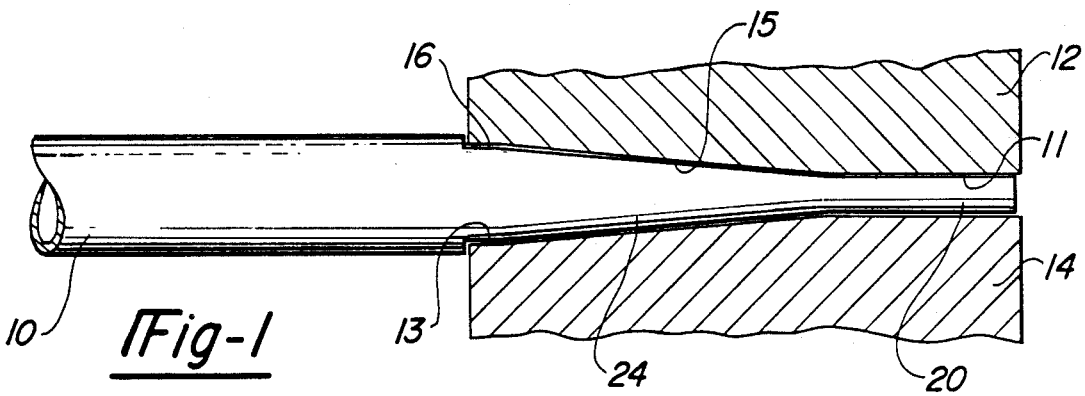
FIG. 1 is a partial cross-sectional view showing a swaging operation on a part of the original tubular starting stock.

Col. 2, line 26, "Figure" should be --Figure 1--.

Col. 2, line 57, "(±0.05" should be --(+0.05--.

Col. 2, line 64, "(+ .050" should be --(± .050--.

Col. 3, line 66, "(± .003" should be --(+ .003--.

Col. 3, line 67, "0.000)" to -- -0.000 inch) --.

Col. 5, line 9, "end portion" should be deleted.

Col. 6, line 15, "step a)" should be --step a),--.

Col. 6, line 53, "thereon" should be --thereon.--.

Signed and Sealed this

Twenty-third Day of October, 1990

*Attest:*

HARRY F. MANBECK, JR.

*Attesting Officer*

*Commissioner of Patents and Trademarks*